US005210884A

United States Patent [19]

Redford

[11] Patent Number: 5,210,884

[45] Date of Patent: May 18, 1993

[54] ENVIRONMENTALLY CONTROLLED TOILET

[76] Inventor: Daniel S. Redford, 5270 Elvira Rd., Woodland Hills, Calif. 91364

[21] Appl. No.: 746,934

[22] Filed: Aug. 19, 1991

Related U.S. Application Data

[63] Continuation-in-part of Ser. No. 570,341, Aug. 20, 1990, abandoned.

[51] Int. Cl.[5] ..... E03D 9/05

[52] U.S. Cl. ..... 4/348; 4/209 R; 4/213; 4/216; 4/217; 4/209 FF

[58] Field of Search ..... 4/347, 348, 349, 350, 4/351, 352, 209 R, 211, 213, 216, 217, 209 FF, 234, 408, 245.1, 237, 238, 239, 240, 223

[56] References Cited

U.S. PATENT DOCUMENTS

| | | | |
|---|---|---|---|
| 1,261,561 | 4/1918 | Landmann | 4/349 |
| 2,172,506 | 9/1939 | Gerger | 4/217 |
| 2,329,221 | 9/1943 | Sanford | 4/213 |
| 2,526,952 | 10/1950 | Kraus | 4/213 |
| 2,828,953 | 4/1958 | Hartmann | 261/DIG. 65 X |
| 3,332,089 | 7/1967 | Wilton | 4/347 X |
| 3,805,304 | 4/1974 | Ikehata | 4/352 |
| 3,887,948 | 6/1975 | Stamper | 4/213 |
| 4,317,242 | 3/1982 | Stamper | 4/217 X |
| 4,433,441 | 2/1984 | Schroeder | 4/213 |
| 4,556,999 | 12/1985 | Lindley | 4/217 |
| 4,692,951 | 9/1987 | Taki et al. | 4/213 X |
| 4,975,990 | 12/1990 | Chan | 4/245.1 |
| 4,993,083 | 2/1991 | Lemieux | 4/216 X |

FOREIGN PATENT DOCUMENTS

| | | | |
|---|---|---|---|
| 1330273 | 5/1962 | France | 4/348 |
| 8806661 | 9/1988 | PCT Int'l Appl. . | |

*Primary Examiner*—Henry J. Recla
*Assistant Examiner*—Glenn T. Barrett
*Attorney, Agent, or Firm*—Albert O. Cota

[57] ABSTRACT

An environmentally controlled toilet designed to neutralize and confine contaminating agents such as bacteria, odors, vapors and other airborne particles inside the bowl by generating and maintaining a cyclone-type air circulation inside the bowl. A bowl (70) with a housing (20), and an air-trapping cavity (76) created inside the bowl (70) by a bowl-skirt (73), confines the contaminating agents during toilet use and improves the efficiency of the air circulation. Sanitizer and odor conditioner cartridges (31) are employed to neutralize the contaminating agents by releasing sanitizing and odor conditioning agents into the air flow circulated inside the bowl (70). A toilet seat (82) having an ergonomic design has a protective skirt (87) that accommodates a hygienic-shield (100). A solution to body heat loss and noise contamination during toilet use is also addressed. The invention is retrofitable to existing toilets, and is applicable to portable toilet systems including children's training toilets.

8 Claims, 11 Drawing Sheets

ENVIRONMENTALLY CONTROLLED TOILET

CROSS-REFERENCE TO RELATED APPLICATIONS

This application is a continuation-in-part of application Ser. No. 07/570,341 filed Aug. 20, 1990 now abandoned.

TECHNICAL FIELD

This invention relates to a system for controlling the environment of toilet bowls used in water flushing toilets and portable toilets including children training toilets, and in particular to a system which generates and maintains a cyclone-type air circulation inside the toilet bowl in order to neutralize the contaminating agents in the toilet during the use and to confine them inside the toilet bowl, for controlling the temperature of the toilet seat, for addressing the noise contamination associated with toilet use, and for further comforting the user by controlling the heat transfer inside of an ergonomically designed toilet seat.

BACKGROUND ART

Numerous apparati and methods have been proposed to address the problems associated with the use of a toilet. The results, however, have been less than satisfactory because the majority of the prior art apparati are addressing only one aspect of the environment surrounding a toilet bowl—the odor. The prior art failed to recognize the cause of the odor contamination problem, and therefore use the principle of ventilation to remove large quantity of air from the toilet bowl and its vicinity and to discharge it unfiltered into the atmosphere, or through a filtering system outside the toilet environment. Other prior art apparatus attempts to create on top of the toilet bowl and underneath the toilet seat an air blanket chemically saturated with aerosols to neutralize the offensive odors leaving the bowl. To be effective, these prior art apparati require relatively powerful blowers which generate unpleasant noise, vibration and air draft, are energy inefficient, complicated, and expensive to maintain. As such, none of these prior art apparati has found any significant consumer acceptance.

A search of the prior art did not disclose any patents that read directly on the claims of the instant invention however, the following U.S. patents were consider related:

| PATENT No. | INVENTOR | ISSUED |
|---|---|---|
| U.S. Pat. No.: | | |
| 5,008,964 | Dean et al. | 23 April 1991 |
| 4,883,749 | Roberts et al. | 28 November 1989 |
| 4,620,329 | Wix | 4 November 1986 |
| 4,586,201 | Todd, Jr. | 6 May 1986 |
| 4,493,117 | Squazzin | 15 January 1985 |
| 4,433,441 | Schroeder | 28 February 1984 |
| 4,094,023 | Smith | 13 June 1978 |
| 3,887,949 | Osmond | 10 June 1975 |
| 3,887,948 | Stamper | 10 June 1975 |
| 2,526,952 | Kraus | 24 October 1950 |
| Foreign Patents: | | |
| 598497 Italy | Asquini | 2 October 1959 |

Dean et al. U.S. Pat. No. 5,008,964 teaches a potty chair for toilet training children, having an automatic speech and tune producing capability.

U.S. Pat. No. 4,883,749 issued to Roberts et al., described a toilet children device for rewarding the toilet user.

Wix in U.S. Pat. No. 4,620,329 ventilates a toilet seat by drawing air from the inside of the vent through a hinge mechanism to a fan where it is vented to atmosphere.

Todd Jr.'s U.S. Pat. No. 4,586,201 teaches a shuttered air inlet introducing air into a blower then through a canister which removes odors and discharges the purified air from the lid.

U.S. Pat. No. 4,493,117 of Squazzin continuously deodorizes a toilet by drawing air from the toilet bowl through a hollow member that snaps over the rim under the seat and is connected to a hose that is in line with a fan carrying the odor laden gases from the toilet to a vent.

U.S. Pat. No. 4,433,441 issued to Schroeder discloses an apparatus positioned on top of a toilet bowl and underneath the toilet bowl seat which generates on top of the bowl an air blanket saturated with aerosols in order to neutralize the offensive odors leaving the bowl.

Osmond's U.S. Patent disclosed a toilet venting assembly positioned between the seat and the toilet tank.

U.S. Pat. No. 3,887,948 issued to Stamper disclosed a solid deodorizer for a toilet venting assembly.

Kraus U.S. Pat. No. 2,526,952 disclosed a toilet ventilating system in which a rubber seal is used to seal the toilet seat to the bowl.

For background purposes and as indicative of the art to which the invention relates, reference may be made to the remaining cited patent issued to Smith and the foreign patent 598497 issued to Asquini in Italy.

DISCLOSURE OF THE INVENTION

The first embodiment of the present invention includes a flushing toilet bowl having a rim provided with a bowl-skirt, and a housing positioned on top of toilet bowl in front of the water tank and behind and below a toilet seat, therefore taking advantage of the unutilized space between the toilet water tank and the toilet seat. The housing, contains a sanitizer/conditioner dispensing means, a motor and a rotor for generating air circulation inside the bowl, a power means, a switch and a timer. The bowl-skirt, as an integrated part of the rim, defines a primary circular air-trapping cavity inside the bowl, where a cyclone-type air circulation is maintained. The air flow moving with a peripheral speed inside the primary air trapping cavity generates centrifugal air currents which bring the air containing the airborne contaminants to the toilet bowl walls. A toilet seat having an elongated strip and an integrated seat-skirt is forming with the bowl rim a secondary air-trapping cavity. The toilet seat and the toilet seat cover are hingeably attached to the housing on top of the toilet bowl rim. The housing has inlet openings, one in position to withdraw air from the primary air-trapping cavity, and a second positioned flush with the top surface of the toilet rim to withdraw air from a secondary air-trapping cavity. An exhaust passage located within the bowl-skirt, generates the cyclone-type air circulation inside the primary air-trapping cavity in the toilet bowl. The cyclone-type air circulation inside the toilet bowl lowers the temperature of the air inside the bowl, forces condensation of contaminated vapors present in the bowl, sanitizes the inside toilet bowl and its content, conditions the odor and confines the contaminating agents inside toilet bowl into the primary air-trapping cavity under the bowl-skirt. A secondary air-trapping cavity under the seat and seat-skirt recovers and confines the eventual escapes. A hygienic-shield, made of disposable material and shaped to follow the toilet seat and seat-skirt upper surface, offers additional protection from bacteria and virus transfer during the toilet use. Finally, the first embodiment of the present invention takes advantage of the suction effect occurring at the end of the toilet flushing cycle, to purge the contaminants into the sewer line.

The second embodiment of the present invention is basically the first embodiment, modified to accommodate existing public/commercial water flushed toilets, where by local regulations the toilet seat must be open in the front. A detachable bowl-skirt positioned on top of the toilet bowl rim and extending downwardly into the toilet bowl forms an air trapping cavity, between the bowl-skirt and the toilet bowl. A housing, shaped to fit any standard toilet bowl in front of the water tank, contains a sanitizer/conditioner dispensing means, a motor and a rotor for generating air circulation inside the bowl, a power means, switch and a timer. Characteristic for the second embodiment of the present invention is the detachable bowl-skirt which is removable attached to the housing by an attachment means such as a complementary pair of snap-lock fasteners. The detachable bowl-skirt defines a circular air-trapping cavity inside the bowl, where a cyclone-type air circulation is maintained. A toilet seat having a seat-skirt and an open front, and a toilet seat cover are hingeably attached to the housing by a pair of support brackets provided with retaining rods. The housing has two inlet openings positioned to withdraw air from the air-trapping cavity, and an exhaust opening positioned inside the bowl below and behind the detachable bowl-skirt, to generate the cyclone-type air circulation inside the air trapping cavity in the toilet bowl.

The third embodiment of the present invention is basically the same as the first embodiment, modified to accommodate all existing water flushed toilets. A housing shaped to fit any standard water flushed toilet bowl on the flat area in front of the water tank. The housing has a similar construction with the one described in the second embodiment of the present invention. A toilet seat having a downwardly extended seat-skirt, and a toilet seat cover are hingeably attached to the housing by a pair of support brackets provided with retaining rods. The retaining rods are used to snap-in the assembled toilet seat and cover into the housing. In this way the assembled toilet seat and cover can be conveniently snapped out of the housing in order to be replaced or to be cleaned outside the bowl. Characteristic of the third embodiment of the present invention is the air-trapping cavity created inside the bowl under the seat, by the seat-skirt. Therefore, the seat has a deeper seat-skirt to compensate for the design of the toilet bowl. The shape of the seat is ergonomically designed to comfort the user's body, distributing the weight of the body over the entire area particularly at the user's back.

The fourth embodiment of the present invention is basically the first embodiment modified to be used in portable toilet systems characterized by the absence of flushing water. In the forth embodiment the air moved inside the bowl-structure in a cyclone-type circulation is cooled by an air cooling agent positioned outside the bowl-structure. A housing integrated to the bowl-structure, contains a sanitizer/conditioner dispenser, an air cooling agent, a motor and a rotor for generating air circulation inside the housing and the toilet structure, a power means and a switch. The air cooling agent could be cold water, ice, or any other heat absorbing material stored in a cooling tray inside the housing in the air circulation path. A toilet seat-skirt, which defines a circular air-trapping cavity inside the bowl-toilet, where a cyclone-type air circulation is maintained, is positioned on top of the rim of the bowl-structure and is coupled with a toilet seat cover by two pin-shafts. The housing has an inlet opening positioned to withdraw the air from the air-trapping cavity inside the bowl-structure and an exhaust opening connected to the bowl-structure to generate the cyclone-type air circulation.

The fifth embodiment of the present invention adds additional features to the previously described embodiments such as: a passive heater for the toilet seat, variable speed for the cyclone-type air circulation, integration of the noise contamination related to the use of toilet. The toilet seat is fitted with a low wattage heat generated flexible membrane. A dedicated microprocessor, controls the heat dissipation inside the toilet seat and indirectly the heat transfer from the user to the seat, by activating and deactivating the seat warming function. The same microprocessor is used to regulate the speed of the motor based on the air temperature inside the bowl. Using a miniature microphone positioned in the housing underneath the seat, the computer is set to detect any embarrassing noise produced during the toilet usage. In response to the input, the computer will use a speech synthesizer and miniature speaker positioned in the same housing, to output a sequence of selected musical chords to integrate the embarrassing noise. An optional display panel may inform the user of the status of the environmentally controlled toilet unit, and deliver customized messages.

In view of the above disclosures is the primary object of the invention to address aspects of toilet bowl environmental problems such as: bacteria, odor, and noise contaminations, in parallel with user's intimate protection and comforting aspects such as a seat/seat-skirt protective shield, seat ergonomics and temperature control.

It is a further object of the invention to condition the toilet bowl, by generating and maintaining a cyclone-type air circulation inside the bowl. By conditioning, the present invention refers to the process of neutralizing the contaminating elements such as bacteria, odors, vapors, and other airborne particles present in the toilet bowl, by mixing them with sanitizer/conditioner agents.

It is also an object of the invention to confine the contaminating elements inside the toilet bowl. The confinement process is premised on the observation that the contaminating elements present in the toilet bowl are carried out due to natural convection, by the warmer air surrounding the odor/bacteria generators inside the bowl. The cyclone-type air circulation forces the contaminating elements to move toward the toilet bowl inside walls, where by coming into contact with the cooler walls their temperature will be lowered and their potential to leave the bowl reduced.

Another object of the invention is to increase the efficiency of the cyclone-type air circulation in neutralizing and confining the contaminating elements inside the bowl, by creating a circular, air-trapping volume inside the bowl.

Another object of the invention is to retrofit the existing water flushed toilet bowls by replacing the existent toilet seat and cover with the environmentally controlled toilet seat.

Further objects of the invention is to introduce the seat-skirt for the following purposes:

- to protect the user for being directly exposed to the draft generated in the toilet bowl by the radial air currents.
- to reduce the body heat loss during the toilet use,
- to allow the use of a disposable seat/seat-skirt protective shield, that protects the user from bacteria and virus transfer not only in public places but also in private homes.

Other objects and advantages of the invention will become obvious from the description of different invention embodiments following the accompanying drawings.

BEST MODE FOR CARRYING OUT THE INVENTION.

The present invention relates to a system for controlling the environment of toilet bowls used in: water flushing toilets, portable toilets including children training toilets. In the following description numerous specific detailed are set forth in order to provide a thorough understanding of the present invention. In other instances, well known devices and elements such as a motor, rotor, timer and switches are not described in detail in order not to unnecessarily obscure the present invention. It should be understood by one skilled in the art that the direction of flow of air and the placement air passages as well as the position of sanitizer/conditioner chambers are not restricted to those described in the figures shown.

THE FIRST EMBODIMENT.

Figure 1:
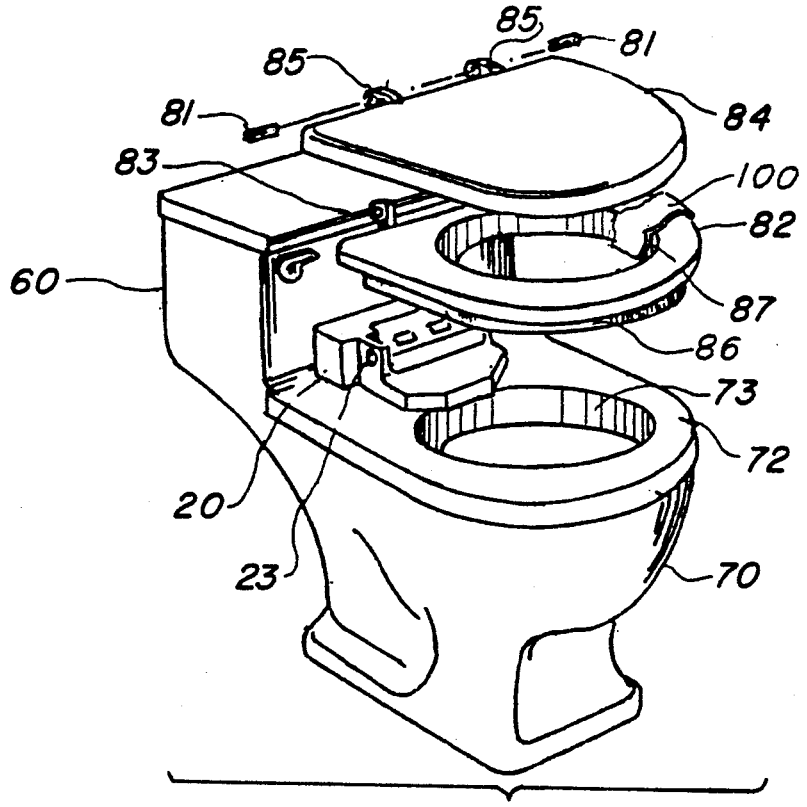
FIG. 1 is a exploded perspective view of the preferred embodiment of the present invention.

FIG. 1 is a exploded perspective view of the preferred embodiment of the present invention. A flushing toilet bowl 70, having a rim 72 and a bowl-skirt 73 as part of the preferred embodiment of the present invention, is shown with a housing 20 mounted on top, and positioned in front of a toilet water tank 60 and behind and below a toilet seat 82. The housing 20 which contains a sanitizer/conditioner dispensing means, an air circulation means, a power means, a switch and a timer, is attached to the top surface of the bowl 70. The toilet seat 82 is shown having an elongated strip 86, a seat-skirt 87 and two brackets 83. A removable toilet seat cover 84 is shown having two pin-shafts 81 on the sides of the two brackets 85. A hygienic-shield 100, made of disposable material and shaped to follow the toilet seat and seat-skirt upper surface, offers additional protection from bacteria and virus transfer during the toilet use. The preferred embodiment of the present invention is installed in the following manner: the existing toilet bowl is removed and replaced with the bowl 70 provided with the rim 72 and the bowl-skirt 73. Two standard vertically disposed openings provided in the bowl 70 are used to secure the housing 20 firmly on top of the rim 72. The toilet seat 82 is then positioned on top of the rim 72, and the brackets 83 holes are aligned outside the bracket supports 23; the toilet seat cover 84 is further positioned on top of the toilet seat 82, with the brackets 85 holes being aligned inside the bracket supports 23. Once in place, the toilet seat and the toilet seat cover brackets will be coupled to the bracket supports 23 of the housing 20 by two pin-shafts 81.

Figure 2:
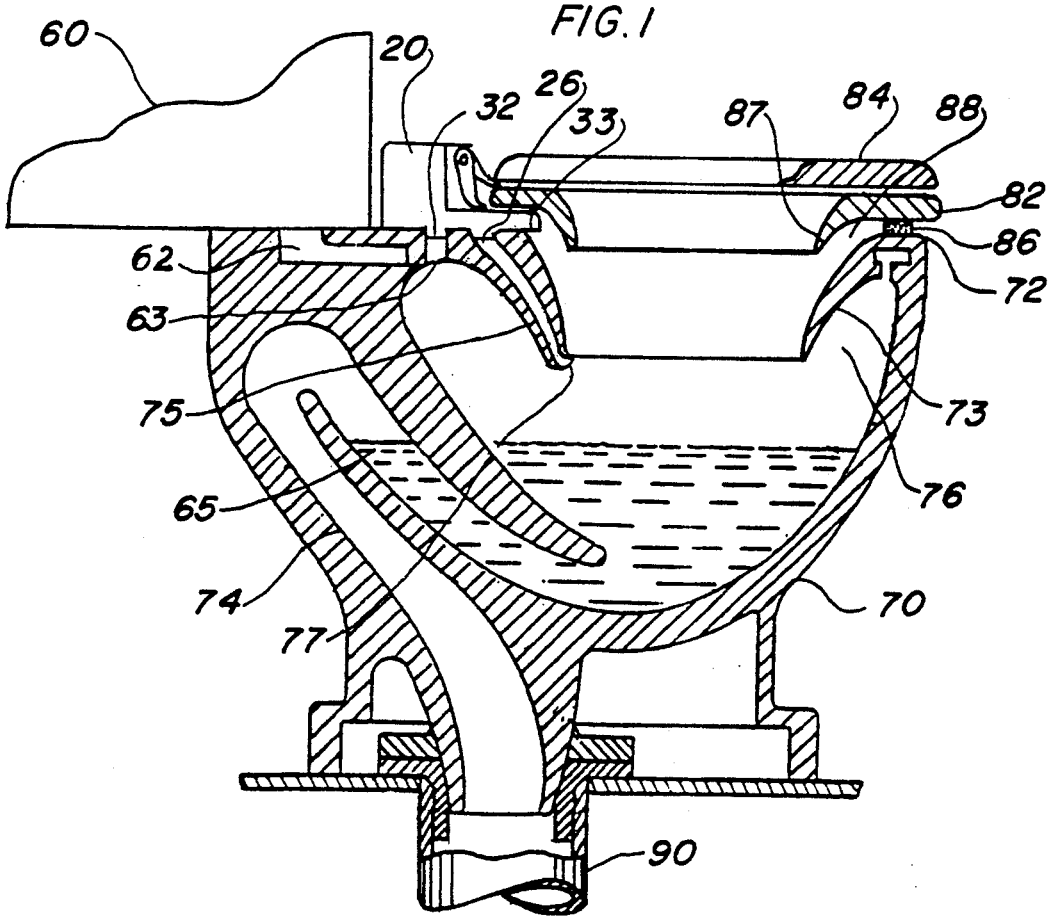
FIG. 2 is an enlarged, longitudinal cross-sectional view of the preferred embodiment of the present invention being connected to a standard sewer line.

FIG. 2 is an enlarged, longitudinal cross-sectional view of the preferred embodiment of the present invention being connected to a standard sewer line 90. The toilet bowl 70 is shown having an interior channel 62 for receiving water from the toilet bowl water tank 60, a sewage connecting duct 74, a water seal 65, and the bowl-skirt 73 provided with an exhaust passage 75 and an intake window 63. The bowl-skirt 73 as an integrated part of the rim 72 defines a primary air-trapping cavity 76 inside the bowl 70. The housing 20 is shown being placed snugly on top of the rim 72 and positioned adjacent to the toilet water tank 60. Further, the housing 20 is shown having an exhaust opening 26 connected to the exhaust passage 75 beneath. Furthermore, the housing 20 is shown having an inlet opening 32 connected to an inlet window 63 positioned in the bowl-skirt 73, and a second intake opening 33 positioned flush with the top surface of the toilet rim 72 and facing the bowl-skirt 73. The bowl-skirt 73 has an exhaust window 77 which is located on the lower end of the exhaust passage 75, facing the inside of the bowl 70, below the skirt 73, and above the water seal 65. Furthermore, the housing 20 is shown detachably coupled to the toilet seat cover 84, and toilet seat 82 having a seat-skirt 87, and an elongated strip 86. The seat-skirt 87 as an integrated part of the toilet seat 82, defines a secondary air-trapping cavity 88, positioned below the toilet seat 82. It should be understood by one skilled in the art that the toilet seat 82 and the toilet seat cover 84 may be raised vertically. The toilet bowl of the present invention contains at various times: water, air, odor/bacteria generators, airborne contaminants, and sanitizing/conditioning agent. The airborne contaminants may consist of: vapors, objectionable odors, bacteria and other airborne particles. When in use, the air inside the toilet bowl is warmed by the odor/bacteria generators which by nature, have higher temperature than the air inside the bowl. It is further understood that the air inside the bowl has the tendency due to natural convection, to leave the bowl and to contaminate the environment surrounding the toilet bowl. Therefore, one of the goals of the preferred embodiment of the present invention, is to lower the temperature of the contaminated air while it is still inside the bowl. Furthermore, another goal of the preferred embodiment is to sanitize and condition the contaminated air inside the bowl 70, to confine it into the primary air-trapping cavity 76 under the bowl-skirt, and to create a secondary air-trapping cavity 88 under the seat-skirt in order to recover the eventual escapes. Further, the present invention takes advantage of the suction effect occurring at the end of the toilet flushing cycle, to purge the confined airborne mixture and its carrier into the toilet sewer line 90.

Figure 3:
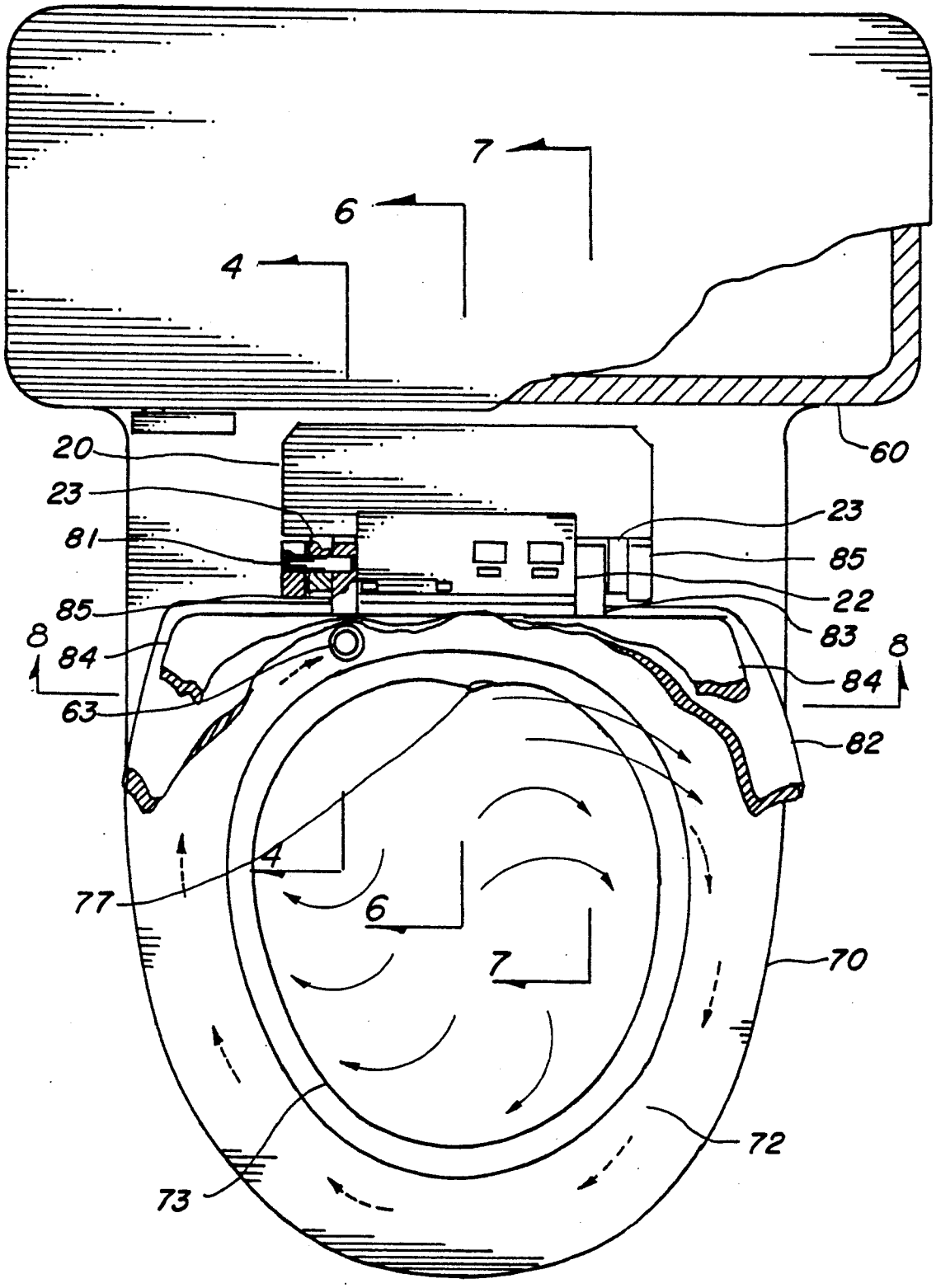
FIG. 3 is a top plan view of the preferred embodiment of the present invention as well as a partial top view of the toilet seat, the toilet seat cover and the housing.

FIG. 3 is a top plan view of the preferred embodiment of the present invention as well of a partial top view of the toilet seat, the toilet seat cover and the housing. The toilet bowl 70 is shown having a water tank 60, a rim 72 and a bowl-skirt 73. The air inlet window 63 positioned in the bowl-skirt 73 connects the inside of the toilet bowl to the intake opening 32, as shown in FIG. 2. Further, the exhaust window 77 is positioned inside the toilet bowl in order to generate and maintain a cyclone-type air circulation inside the bowl. In this preferred embodiment, the cyclone-type air circulation inside the toilet bowl is shown moving the contaminated air, along the primary air-trapping cavity 76 (shown in FIG. 2). This cyclone-type air circulation mixes the cooler air, sweeping along the toilet bowl 70 walls with the warmer and contaminated air to lower its temperature. Additionally, the cyclone-type air circulation generates secondary air currents moving radially from the center of the bowl toward the toilet bowl walls. These secondary air currents carry the contaminated air from the center region of the toilet bowl and mixes it with the cooler air sweeping tangentially on the inside bowl walls. Also the vapors in the airborne contaminants will come into contact with the cooler toilet bowl walls and will condense. The sanitizer/conditioner agent released inside the housing 20 is mixed with the airborne contaminants and is continuously sanitizes the inside of the toilet bowl, reducing bacterial count and conditioning the odor. By recirculating the air inside the toilet bowl, the present invention circulates the santizer/conditioner agents in an economically and environmentally safe way.

Figure 4:
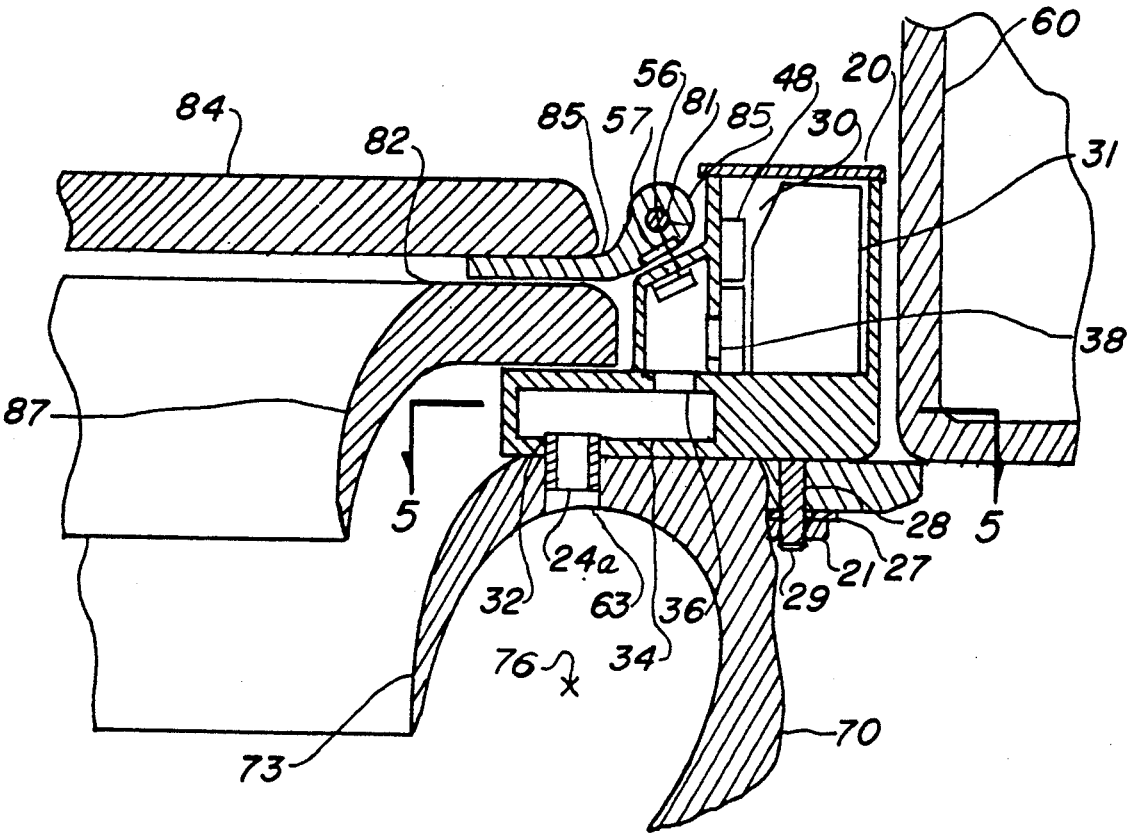
FIG. 4 is a partial, right-side view of the preferred embodiment of the present invention taken substantially upon the planes indicated by section lines 4—4 of FIG. 3.
Figure 5:
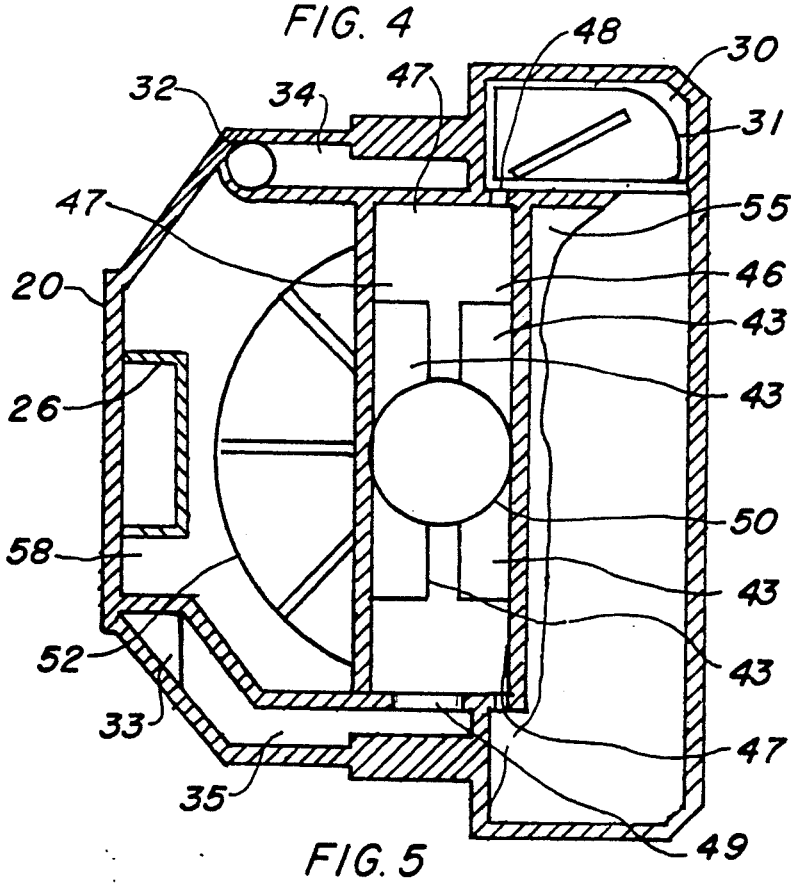
FIG. 5 is a partial, top plan view of housing taken substantially upon the plane indicated by section lines 5—5 of FIG. 4.

FIG. 4 is a partial, right-side view of the preferred embodiment of the present invention taken substantially upon the planes indicated by section lines 4—4 of FIG. 3. The housing 20 is shown having a pipe 24*a* connecting the primary inlet window 32 with the air-intake opening 63 positioned into the bowl-skirt 73. The primary inlet window 32 further communicates with a channel 34 which is further coupled with a sanitizer/-conditioner chamber 30 via windows 36 and 38. A sanitizer/conditioner cartridge 31 is shown within the chamber 30. The sanitizing/conditioning chamber 30 communicates to the low pressure mixing chamber 47, as shown in FIG. 5, over a window section 48. Furthermore, FIG. 4 shows the housing 20 being secured to the bowl 70 by the captive holding studs 29 disposed inside the vertical openings 28. Washers 27 and wing-nuts 21 are used to fasten housing 20 to the bowl 70.

Figure 7:
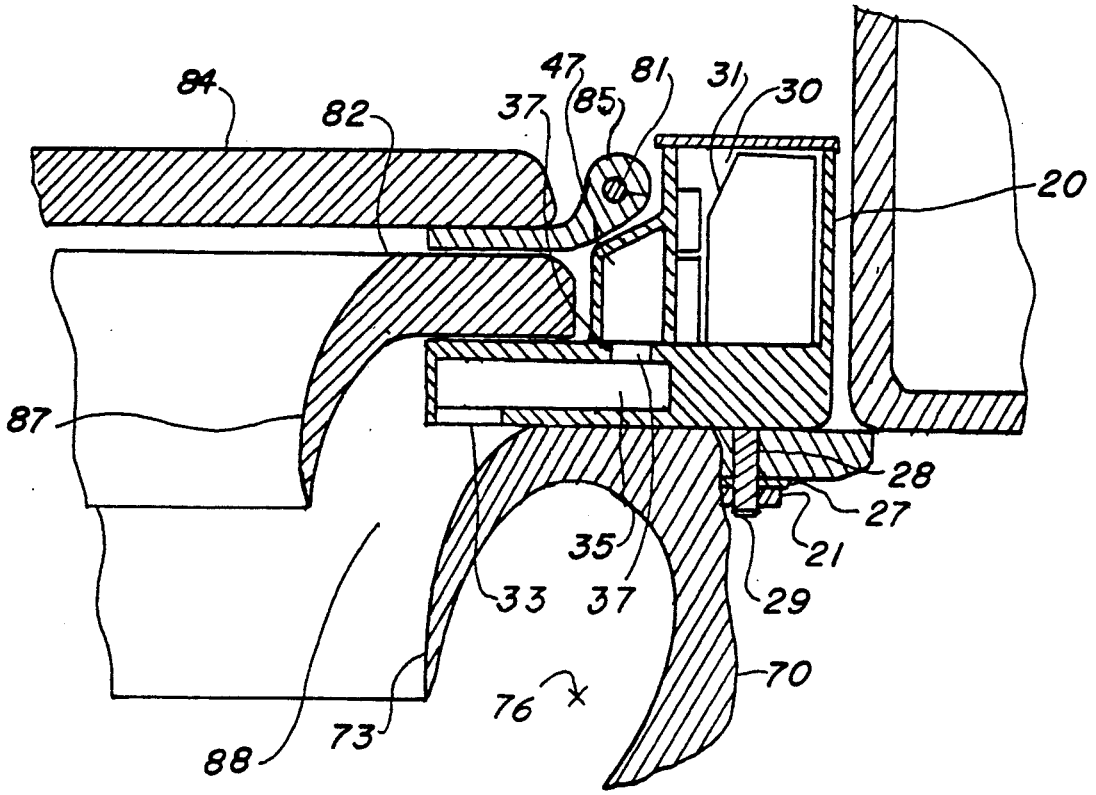
FIG. 7 is a partial, right-side view of the preferred embodiment taken substantially upon the planes indicated by section lines 7—7 of FIG. 3.

FIG. 5 is a partial, top plan view of housing 20 taken substantially upon the plane indicated by section lines 5—5 in FIG. 4. A motor 50 and an associated rotor 52 are centrally disposed within the housing 20 for the purpose of recirculating the air inside the toilet bowl. The air withdrawn from the bowl by the rotor 52, enters the housing 20 using two different paths. In the primary path the air is withdraw from the primary air-trapping cavity 76, as shown in FIG. 4, through the inlet opening 32 into the sanitizer/conditioner chamber 30 via the intake channel 34 and window sections 36 and 38, as shown in FIG. 4. Further, the air is withdrawn from the chamber 30 through the window section 48 into a low pressure mixing chamber 47. The size of the window section 48 is adjustable to provide control over the amount of sanitizer/conditioner agent dispersed. In the secondary path, the air is withdrawn from the secondary air-trapping cavity 88 into the low pressure mixing chamber 47 through the window section 49, via the inlet opening 33, the intake channel 35, through a window section 37, as shown in FIG. 7. A holding plate 46 secures the motor 50 and the rotor 52 to the housing 20 and separates the low pressure mixing chamber 47 from a high pressure exhaust chamber 58. Four intake areas 43 in the holding plate 46 allows air to enter the exhaust chamber 58 containing the rotor 52 to pressurize the air in the high pressure exhaust chamber 58.

Figure 6:
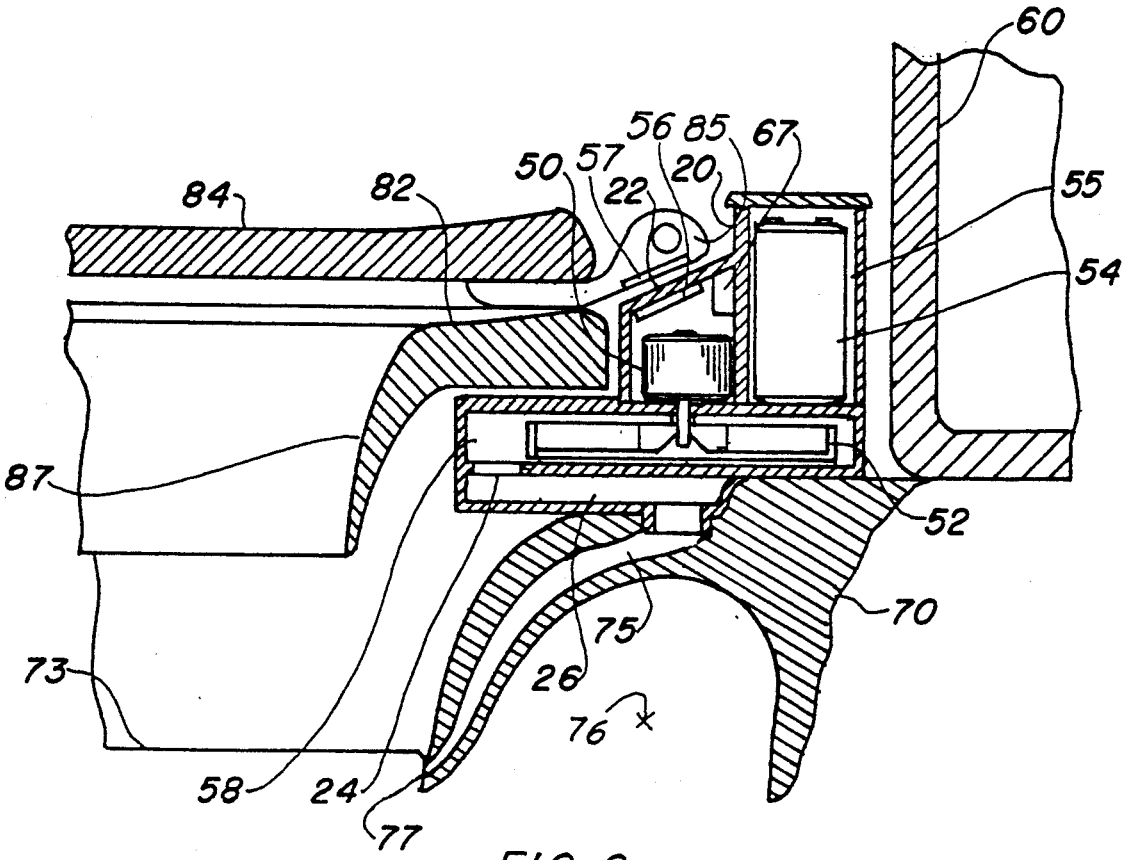
FIG. 6 is a partial right-side view of the preferred embodiment taken substantially upon the plane indicate by lines 6—6 of FIG. 3.

FIG. 6 is a partial right-side view of the preferred embodiment taken substantially upon the plane indicate by lines 6—6 of FIG. 3. In the housing 20, the high pressure exhaust chamber 58 is shown connected to the outlet channel 26 via a window section 24. Further, the outlet channel 26 is shown connected to the exhaust passage 75 positioned inside the bowl-skirt 73. It is the shape and position of the exhaust window 77 at the end of the exhaust passage 75, which makes the air to be returned to the toilet bowl environment with high speed in order to generate and maintain the cyclone-effect. By positioning the housing 20 above the toilet rim 72 the preferred embodiment protects the motor 50 against fluid contamination in case of toilet bowl overflow. The same protection is offered to the storage battery cells 54 which are housed in the battery compartment 55 positioned on top of the high pressure exhaust chamber 58. A proximity switch 56 controls the operation of the motor 50. A magnet 57 positioned in the seat cover bracket 85 translates the position of the toilet seat cover 84. A timer 67 located underneath the control panel 22, provides the function of de-energizing the motor 50 after a specific period of time, in case the seat cover 84 is not closed.

FIG. 7 is a partial, right-side view of the preferred embodiment taken substantially upon the planes indicated by section lines 7—7 of FIG. 3. The housing 20 is attached to the bowl 70 and is shown having the second inlet opening 33 positioned flush on top of the bowl 70 facing the bowl-skirt 73. The air is withdrawn from the secondary air-trapping cavity 88 into the low pressure mixing chamber 47, via the inlet opening 33, the intake channel 35, and window sections 37 and 49, as shown in FIG. 5.

Figure 9:
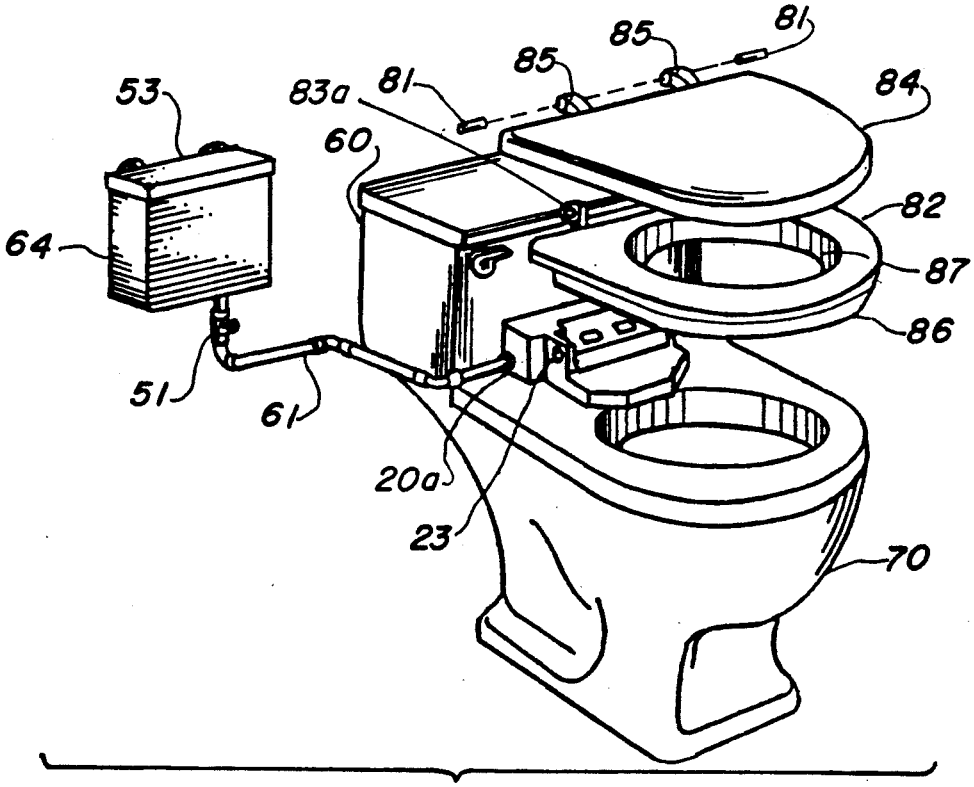
FIG. 9 is a exploded perspective view of the first embodiment, showing a sanitizer/conditioner container positioned outside the housing.

FIG. 9 is a exploded perspective view of the preferred embodiment, showing a sanitizer/conditioner container 64 positioned outside the housing **20*b*. The container 64, having a cover 53 and a shut-off valve 51, is shown hanging on a wall in the proximity of the toilet bowl 70. A supply line 61 connects the container 64 to the housing 20*b*. The container 64** is design to hold significant more sanitizer/conditioner agent, to be easy to refill, and will be probably used to replace the sanitizer/conditioner cartridges when the present invention is installed in public toilet facilities.

Figure 21:
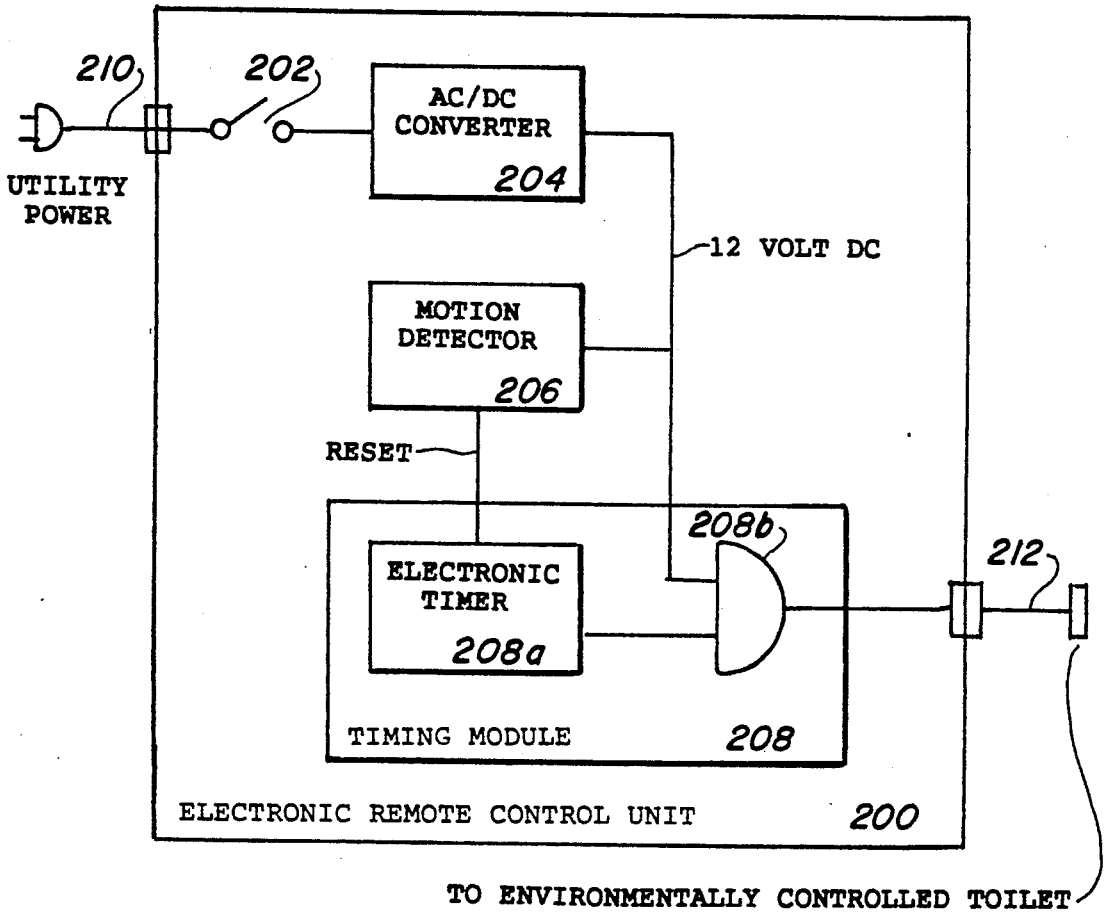
FIG. 21 is a block diagram of an Electronic Remote Control Unit for the Environmentally Controlled Toilet.

FIG. 21 a block diagram for an electronic remote control unit 200 that allows the toilet to be operated and controlled from a remote location. The unit 200 comprised of the following major components: a power switch 202, an ac/dc converter 204, a motion detector 206, a timing module 208, a power input cable 210 and a unit/toilet interface cable 212. The power to the unit 200 is supplied from either the 110 volt a-c or 220 volts a-c utility power source. The unit may be hard-wired directly to the power source or, the power input cable 210 may be employed. When the power switch 202 is placed in the ON position, the a-c power is applied to the ac/dc converter 204 which converts the a-c power to a low voltage d-c. The low voltage d-c power is applied to the motion detector 206 and to an AND gate **208*b* in the timing module 208. The motion detector is maintained in a quiescent state. Therefore, when a motion is detected within the confines of the monitored area, the motion detector generates a reset signal to the electronic timer 208*a* also located in the timing module 208. The reset signal causes the electronic timer to begin timing out from a preset number of seconds. The on-time of the timer 208*a* will continue for the preset time unless electronic timer is interrupted by a subsequent reset signal at which time, the preset time commences from the beginning. During the electronic timer's on-time, a signal is produced that enables the AND gate 208*b*. The enabled gate allows the d-c current to pass on, via the unit/toilet interface cable 212**, to the environmentally controlled toilet.

THE SECOND EMBODIMENT

Figure 18:
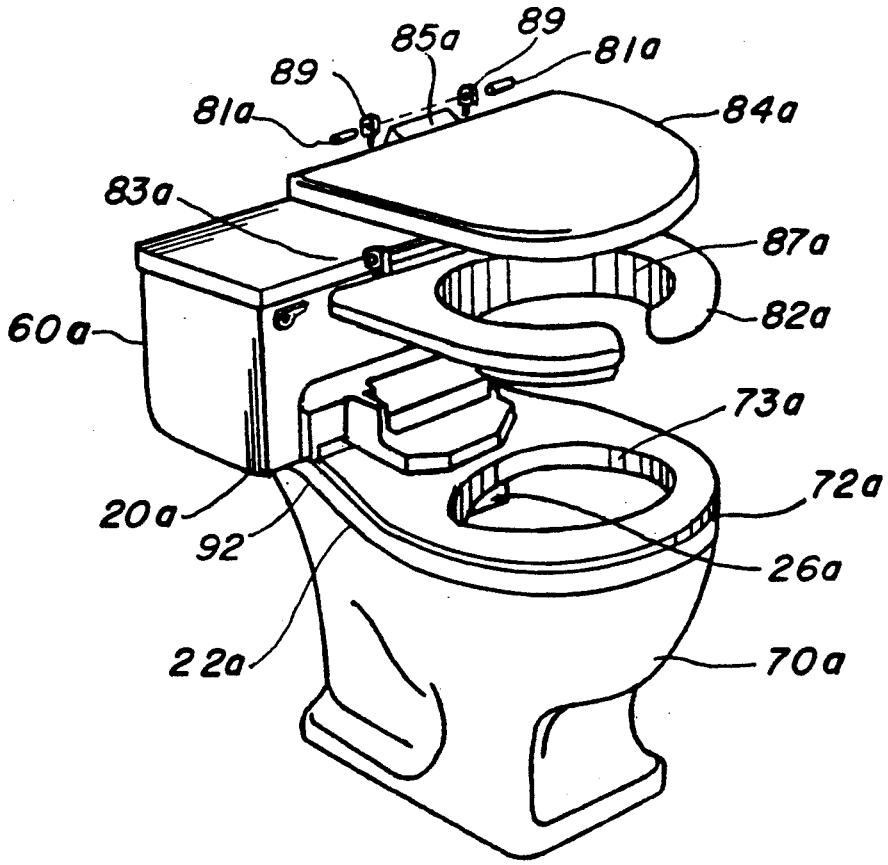
FIG. 18 is an exploded perspective view of the second embodiment, being installed on a conventional water flushed toilet.
Figure 19:
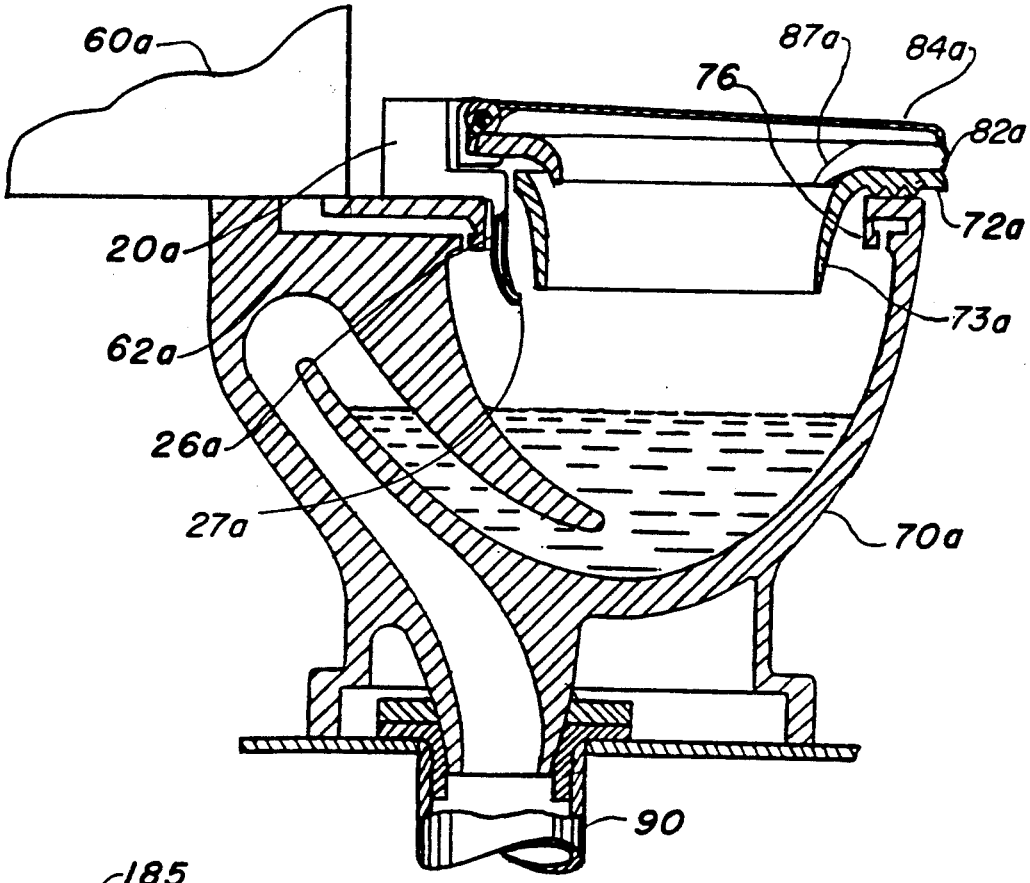
FIG. 19 is an enlarged, longitudinal cross-sectional view of the second embodiment, being integrated with a conventional water flush toilet.

The second embodiment of the present invention in depicted in FIG. 18 and FIG. 19 and is basically the first embodiment, modified to accommodate the existing bowls of the public/commercial water flushed toilets, where by local regulations the bowl is of an elongated type and the toilet seat must be open in the front.

FIG. 18 is an exploded perspective view of the second embodiment being installed on a conventional water flushed toilet. A housing **20*a*, is shaped to fit any standard water flushed toilet bowl 70*a* on the flat area in front of the water tank 60*a*. A detachable bowl-skirt 73*a* is shown positioned on top of the toilet rim 72*a*, in front of the housing 20*a*. An open-front toilet seat 82*a* is shown having a downwardly extending seat-skirt 87*a* and two seat brackets 83*a*. A removable toilet seat cover 84*a* is also shown having a bracket 85*a* in position to be integrated with bracket supports 89, seat brackets 83*a* and pin-shafts 81*a*. The second embodiment is installed in the following manner: the existing toilet seat and toilet seat cover are removed and the two standard vertically disposed openings provided in the bowl 70*a* are used to secure the housing 20*a* firmly on top of the rim 72*a* in front of the water tank 60*a*. The detachable bowl-skirt 73*a* is installed in front of the housing 20*a* on top of the toilet rim 72*a* and attached to the housing 20*a* by two snap-lock fasteners 92. The toilet seat 82*a* and the toilet seat cover 84*a* which are first assembled with the bracket supports 89, are snapped into two vertical openings provided in the housing 20*a***.

FIG. 19 is an enlarged, longitudinal cross-sectional view of the second embodiment being integrated with a conventional water flush toilet. A housing **20*a* is shown being placed snugly on top of the toilet bowl rim 72*a* and positioned adjacent to the toilet water tank 60*a*. Further, the housing 20*a* is shown having an exhaust tongue 26*a* extended into the toilet bowl 70. The detachable bowl-skirt 73*a* is shown installed on the top of the rim 72*a* and below the open-front seat 82*a*. The toilet seat 82*a* is shown having a seat-skirt 87*a*. It should be understood by one skilled in the art that the toilet seat 82*a* and the toilet seat cover 84*a* may be raised vertically. All the goals discussed in the preferred embodiment are shared by the second embodiment. Characteristic for the second embodiment is only one air-trapping cavity created inside the bowl 70*a*, by the detachable bowl-skirt 73*a* positioned in top of the toilet bowl rim 72*a*. Also, the housing 20*a* has the exhaust tongue 26*a* positioned in front of the toilet bowl rim 72*a*, and its exhaust window 27*a* located deeper inside the bowl 70*a*, behind the detachable bowl-skirt 73*a***.

THE THIRD EMBODIMENT

The third embodiment of the present invention is depicted in FIG. 10 through 17 and is basically the first embodiment, modified to accommodate the standard bowls of existing water flushed toilets.

Figure 10:
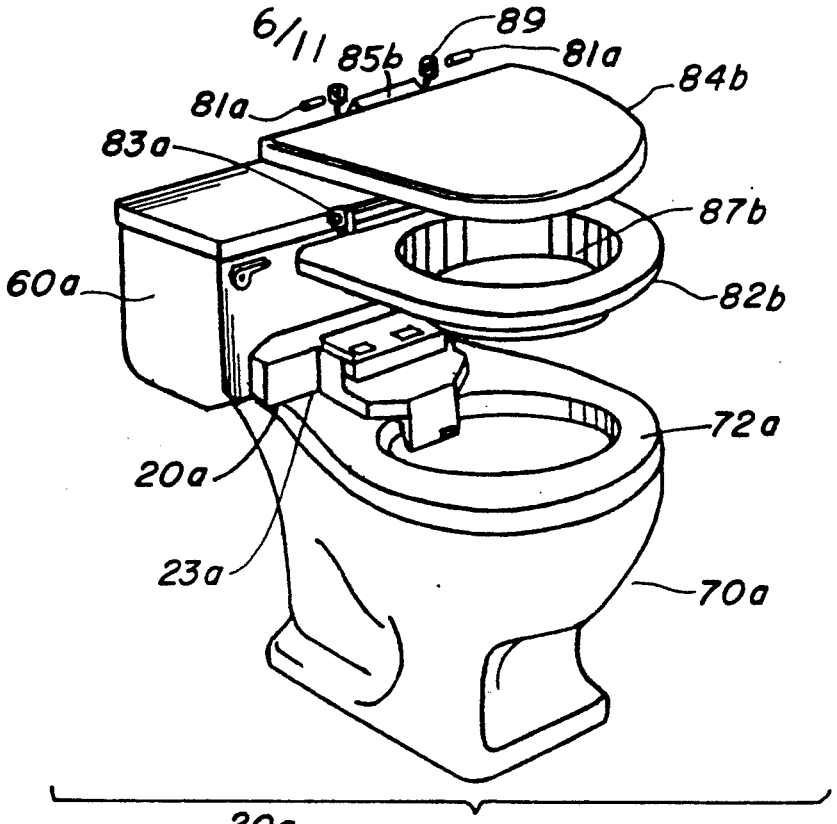
FIG. 10 is an exploded perspective view of the third embodiment, being installed on a conventional water flushed toilet.

FIG. 10 is an exploded perspective view of the third embodiment installed on a conventional water flushed toilet. A housing **20*a*, is shaped to fit any standard water flushed toilet bowl 70*a*. A toilet seat 82*b* having a downwardly seat-skirt 87*b* and a seat cover 84*b* is shown in position to be integrated with two bracket supports 89. The third embodiment of the present invention is installed in the following manner: the existing toilet seat and toilet seat cover are removed and the two standard vertically disposed openings provided in the bowl 70*a* are used to secure the housing 20*a* firmly on top of the rim 72*a* in front of the water tank 60*a*. The toilet seat 82*b* and the toilet seat cover 84*b* are first assembled with the bracket supports 89. Two pin-shafts 81*a* are used to align toilet seat brackets 83*a* and seat cover bracket 85*b* and to sandwich brackets support 89 between them. Two vertical retaining rods part of the bracket supports 89, together with the mating vertical openings 23*a* in the housing 20***a*, are used to snap-in the assembled toilet seat and cover into the housing 20*a*. In this way the assembled toilet seat and cover can be conveniently snapped out of the housing 20*a* when it is to be replaced or cleaned outside the bowl.

Figure 11:
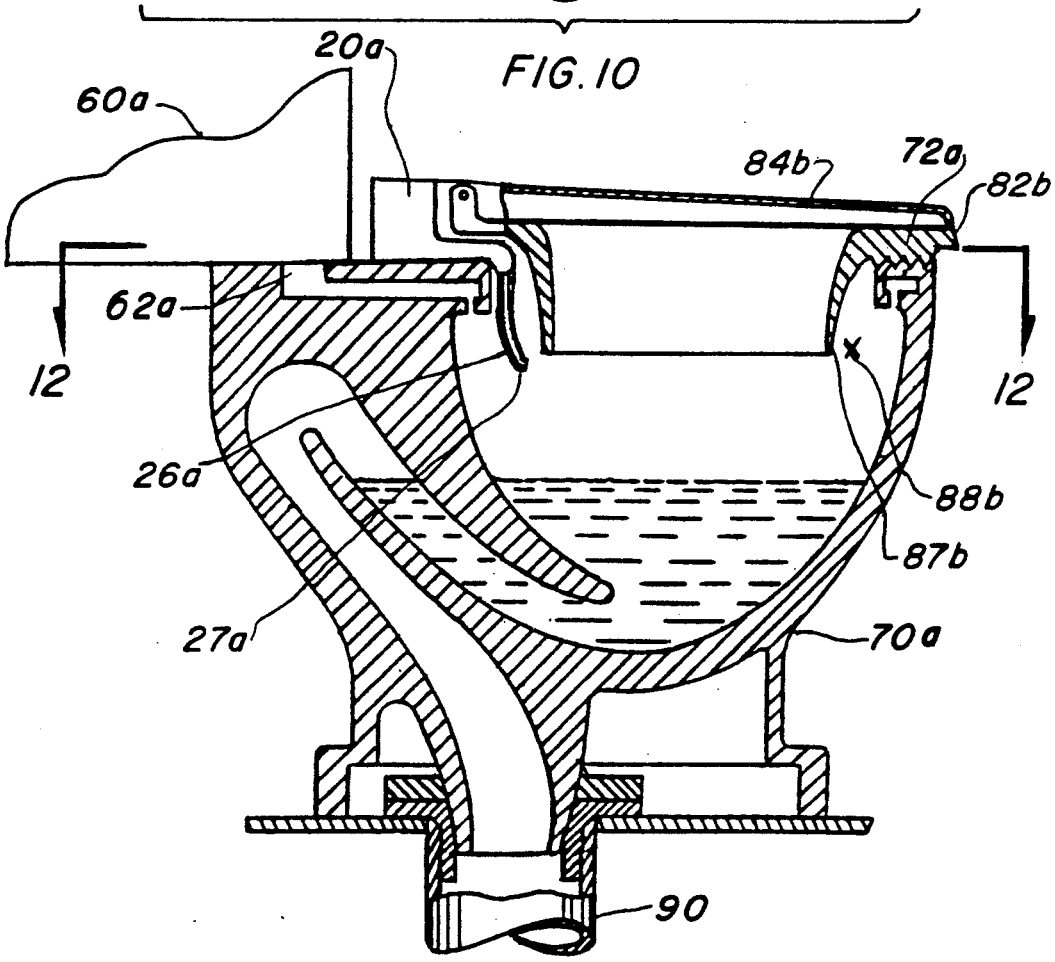
FIG. 11 is an enlarged, longitudinal cross-sectional view of the third embodiment, being integrated with a conventional water flush toilet.

FIG. 11 is an enlarged, longitudinal cross-sectional view of the third embodiment. The housing 20*a* is shown being placed snugly on top of the toilet bowl rim 72*a* and positioned adjacent to the toilet water tank 60*a*. Further, the housing 20*a* is shown having an exhaust tongue 26*a* extended into the toilet bowl 70*a*. The toilet seat 82*b* is shown having a seat-skirt 87*b* extended deeper inside the toilet bowl 70*a*, below the rim 72*a*, for the purpose of defining an air-trapping cavity 88*b*. The shape of the seat 82*b* is ergonomically designed to comfort to the user's body distributing the weight of the body over the entire area particularly at the user's back. It should be understood by one skilled in the art that the toilet seat 82*b* and the toilet seat cover 84*b* may be raised vertically. All the goals stipulated in the preferred embodiment are shared by the third embodiment. Characteristic for the third embodiment is only one air-trapping cavity formed by the seat-skirt 87*b* inside the bowl 70*a*. Therefore, the seat 82*b* has been provided with a deeper seat-skirt 87*b* to compensate for the design of the toilet bowl 70*a*. Also, the housing 20*a* has the exhaust tongue 26*a* positioned in front of the toilet bowl rim 72*a*, and its exhaust window 27*a* located deeper inside the bowl, behind the seat-skirt 87*b*.

Figure 12:
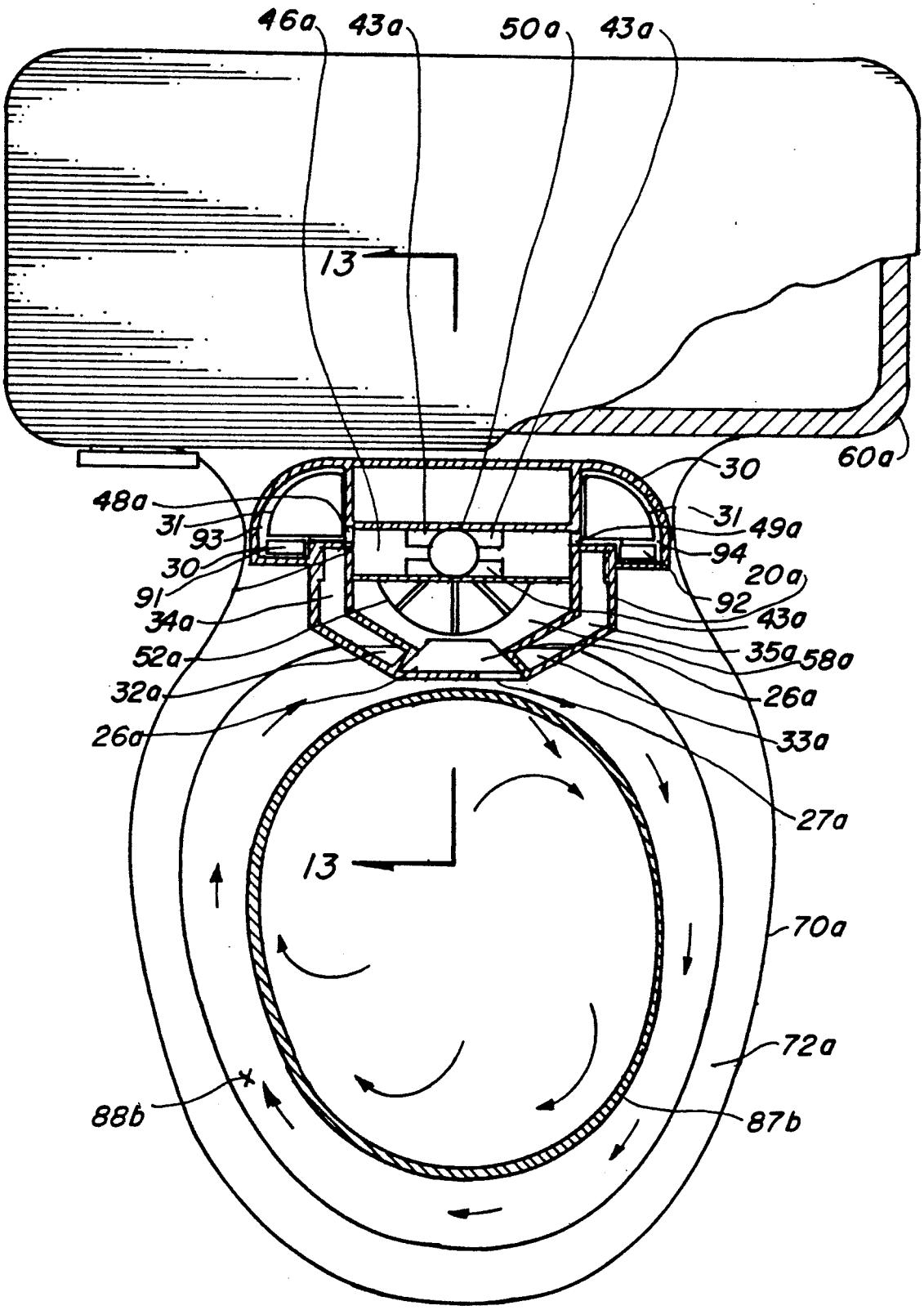
FIG. 12 is a top plan view of the third embodiment, being taken substantially upon the planes indicated by section lines 12—12 of FIG 11.

FIG. 12 is a top plan view of the third embodiment being taken substantially upon the planes indicated by section lines 12—12 of FIG. 11. The housing 20*a* is shown having two inlet windows 32*a* and 33*a* positioned flush with the top surface of the toilet rim 72*a* and facing the interior of the bowl 70*a*. A motor 50*a* and a rotor 52*a* are centrally disposed within the housing 20*a* for the purpose of circulating the air inside the bowl. The air withdrawn from the air-trapping cavity 88*b* enters the housing 20*a* using two identical paths. In the first path, the inlet window 32*a*, is shown communicating via an intake channel 34*a* and a horizontal window 91, with the sanitizer/conditioner chamber 93. In the second path, the inlet window 33*a* is shown communicating via the intake channel 35*a* and a horizontal window 92 with a chamber 94. Two sanitizer/conditioner cartridges 31 positioned in chamber 93 and 94 are releasing sanitizing and odor conditioning agents into the low pressure mixing chamber 47*a* through the window section 48*a*, respectively window section 49*a*. A holding plate 46*a* secures the motor 50*a* and the rotor 52*a* to the housing 20*a* and separates the low pressure mixing chamber 47*a* from a high pressure exhaust chamber 58*a*. Four intake openings 43*a* in the holding plate 46*a* allows rotor 52*a* to pressurize the air into the high pressure exhaust chamber 58*a*. Furthermore, housing 20*a* has the exhaust tongue 26*a* provided with an exhaust window 27*a* positioned inside the toilet bowl in order to generate and maintain a cyclone-type air circulation inside the air-trapping cavity 88*b*.

Figure 13:
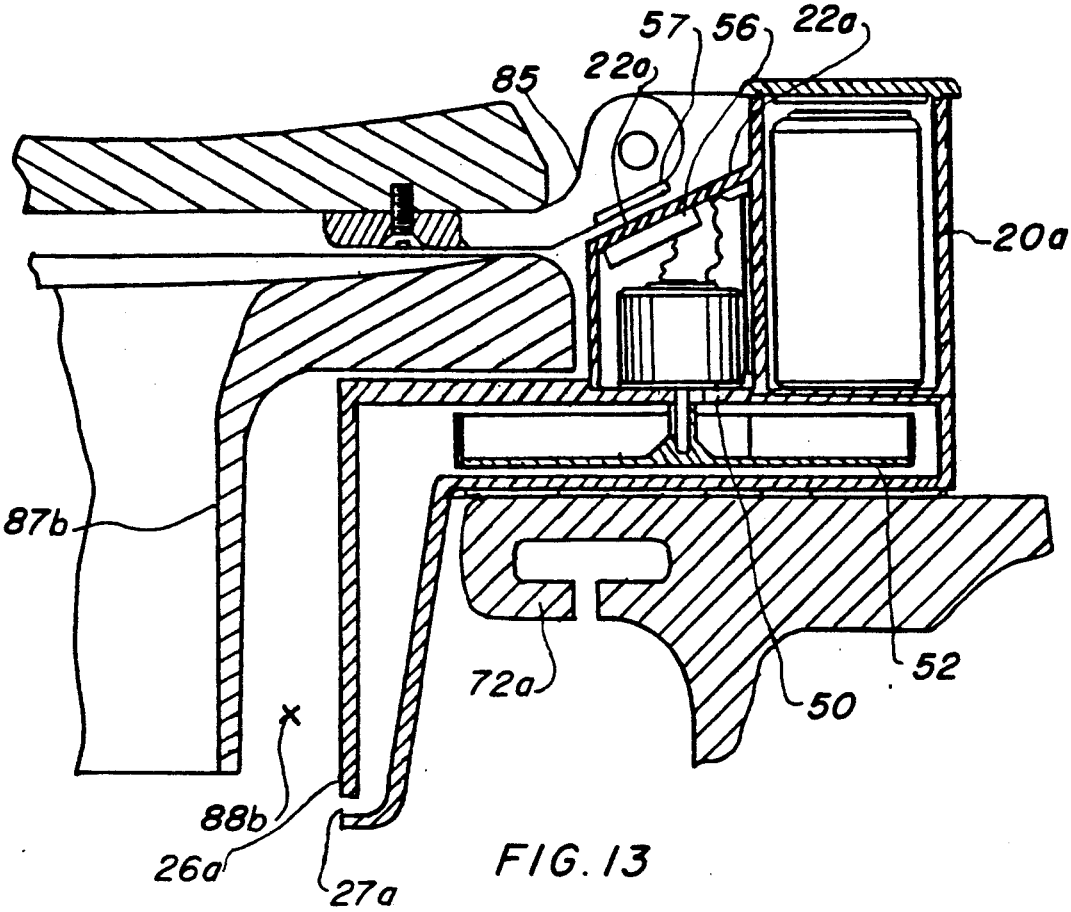
FIG. 13 is a partial, right-side perspective view of the third embodiment, taken substantially upon the planes indicated by section lines 13—13 of FIG. 12.

FIG. 13 is a partial, right-side view of the third embodiment taken substantially upon the planes indicated by section lines 13—13 of FIG. 12. The housing 20*a*, is shown having an exhaust tongue 26*a* positioned inside the air-trapping cavity 88*b* in front of the toilet rim 72*a* and behind the seat-skirt 87*b*. It is the shape and position of the exhaust window 27*a* at the end of the exhaust tongue 26*a*, which makes the pressurized air to return into the toilet bowl with high speed in order to generate and maintain the cyclone-effect.

Figure 14:
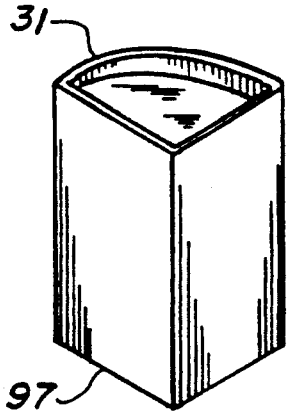
FIG. 14 to FIG. 16 depict three different types of sanitizer/conditioner cartridges to be employed with all the embodiments of the present invention.
Figure 15:
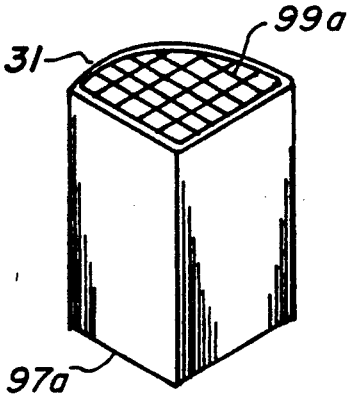
Figure 16:
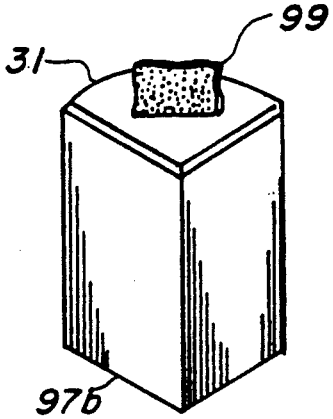

FIGS. 14 through 16 depict three different types of sanitizer/conditioner cartridges to be employed with all the embodiments of the present invention. FIG. 14 shows a sanitizer/conditioner cartridge 31 in powder form in a container 97, or simply in block form of the same shape of a solid media well known in the art and frequently used as an air deodorizer or freshener. FIG. 15 shows a sanitizer/conditioner cartridge 31 in a liquid form housed in a container 97*a* with a horizontally positioned wick 99*a* designed to draw the liquid into an extended surface in the airstream path for vaporization. FIG. 16 shows a sanitizer/conditioner cartridge 31 in a liquid form housed in a container 97*b* with a vertically positioned wick 99.

Figure 17:
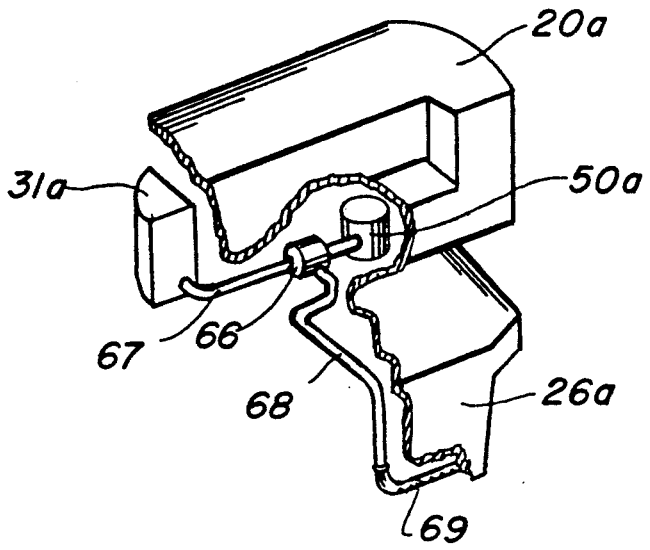
FIG. 17 depicts the implementation where sanitizer/-conditioner cartridge of a liquid type is connected to a pump which discharge it inside the bowl.

FIG. 17 depicts another aspect of the third embodiment wherein a liquid form sanitizer/conditioner cartridge 31*a* is connected to a liquid pump 66 located in the housing 20*a* by a tube 67. The sanitizer/conditioner agent is dispersed via a tube 68 connecting to the pump 66 to a delivery-manifold 69 positioned in the housing 20 and facing the inside the toilet bowl, preferably, at the extreme end of the exhaust tongue 26*a*. A series of orifices provided on the delivery-manifold 69 allow the liquid to be sprayed inside the toilet bowl when the motor 50*a* starts.

THE FOURTH EMBODIMENT.

Figure 20:
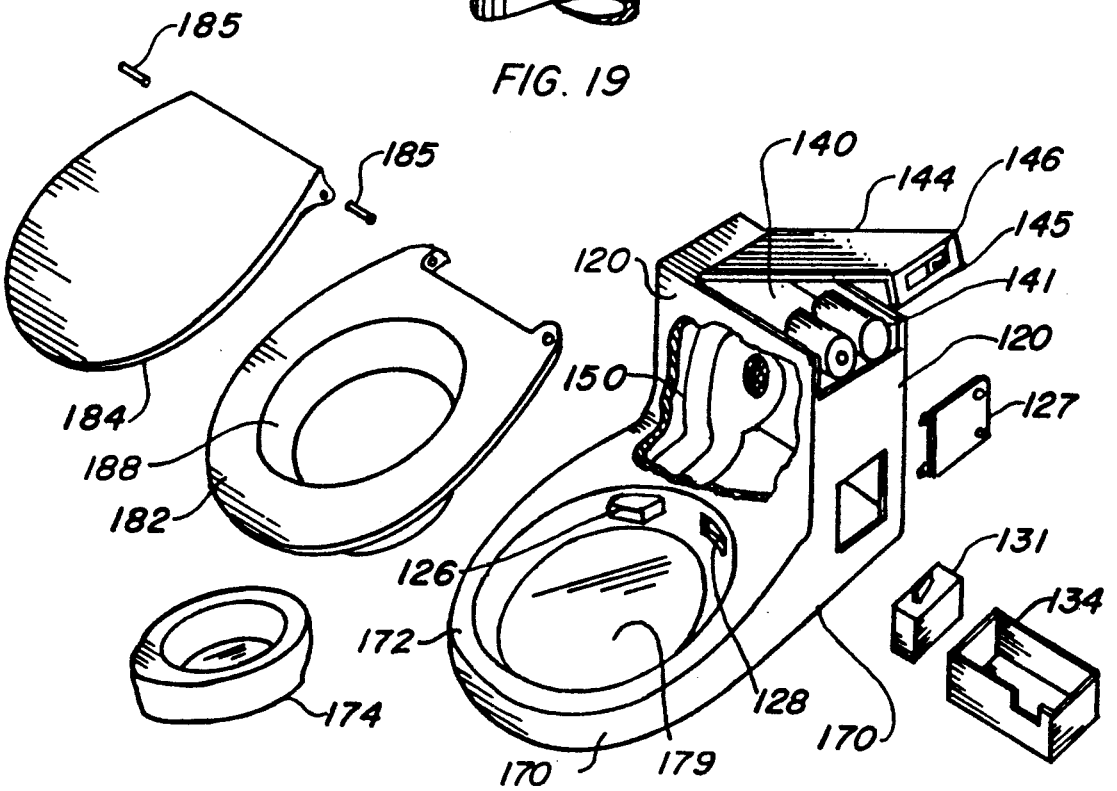
FIG. 20 is an exploded perspective view of the fourth embodiment, being installed into a children training toilet-potty chair.

The fourth embodiment of the present invention depicted in FIG. 20 is shown applied to portable toilets including children training toilets—potty chairs. A cyclone-type air circulation inside the bowl-structure 170 is facilitated by a circular air-trapping cavity created by the seat-skirt 173. The circular shaped bowl-structure 170 has a rim 172 and a bottom 179 and may hold in the center a removable potty 174. A toilet seat cover 184 attached to the toilet seat 182 by a shaft 185, will seal the portable toilet after use until the potty 174 is removed for cleaning purposes. The cyclone-type air circulation inside the bowl-structure 170 is generated and maintained by a blower/motor structure 150 installed inside a housing 120. An exhaust opening 126 and an inlet opening 128 are positioned inside the bowl-structure 170 for air circulation purposes for the reasons discussed in the previously described embodiments of the present invention. The inlet opening 128 connects the inside the bowl-structure 170 with the inside of the housing 120 which also contain the sanitizer/conditioner cartridge 131 and a removable air-cooling tray 134. Characteristic of the fifth embodiment is the air-cooling tray 134 which contain cooling agents such as: cold water, ice cubes, or any other heat absorbent substance, for the purpose of cooling the air circulated inside the housing 120 and bowl-structure 170. Further, the housing 120 is sealed from the exterior by door structure 127. On the upper section of the housing 120 is located a battery compartment 140 with batteries 141, a cover 144 and a control panel 145 with a switch 146. Control features similar with those disclosed in the second embodiment, can be included in this embodiment. The fifth embodiment is installed in the following manner: the potty 174 is placed inside the bowl-structure 170, the toilet seat 182 and the attached toilet seat cover 184 is positioned on top of the rim 172 and the air-cooling tray 134 containing a air cooling agent is positioned inside the housing 120 together with the sanitizer/conditioner cartridge 131.

THE FIFTH EMBODIMENT

Figure 8:
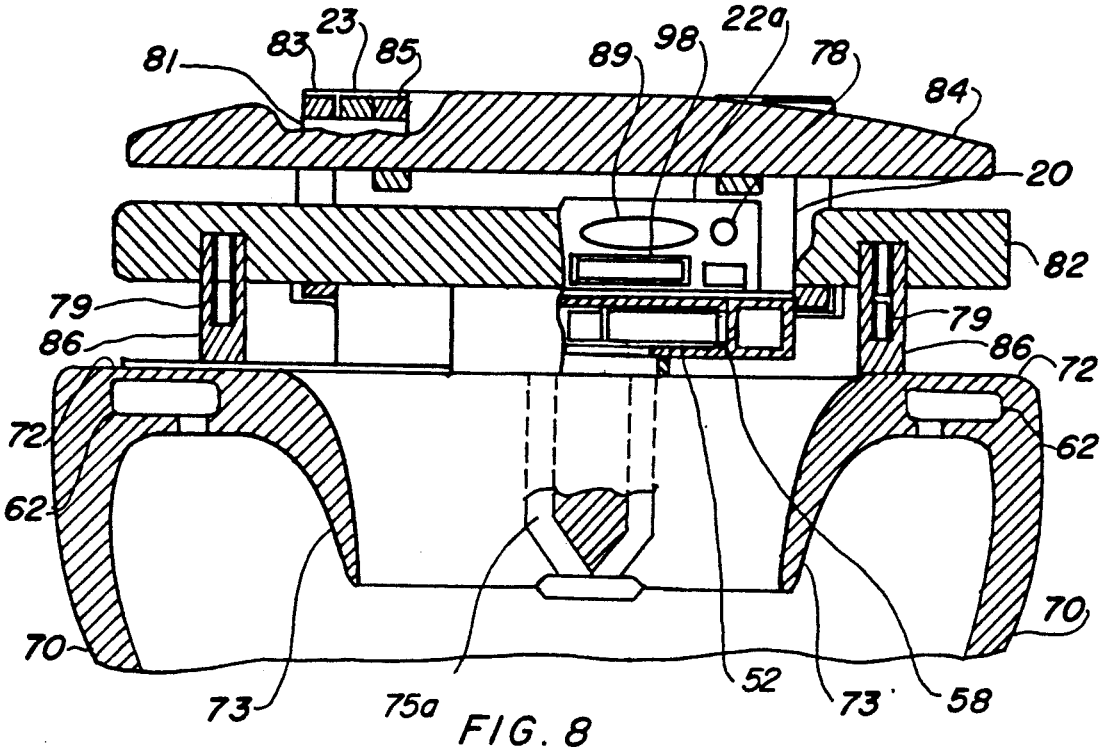
FIG. 8 is a front view of a fifth embodiment of the present invention, taken substantially upon the planes indicated by lines 8—8 of FIG. 3.

FIG. 8 is a front view of a fifth embodiment of the present invention, taken substantially upon the planes indicated by lines 8—8 of FIG. 3. A housing 20 is shown coupled to two exhaust passages 75*a*, an elongated strip 86*a* is also shown attached to the toilet seat 82*a* fitted with a heat generated coil 79. Preferably, the heat generating coil is a flexible heating membrane which can be integrated with the elongated strip 86*a*. A computerized control panel 22*a* is located in the housing 20*a* and behind the toilet seat 82*a*. It provides control switches for temperature range selection for the toilet seat, for activating and deactivating the seat warming function and for regulating the speed of the rotor 52*a*. The computerized control panel 22*a* further has a noise activated sensor 78 and a miniature speaker 89 to provide further environmental control functions.

The noise activated sensor 78 is computer controlled and is set to detect the embarrassing noise generated during toilet use. In response to the input to the sensor 78, the computer uses the miniature speaker 89 to output a sequence of selected musical chords to integrate the embarrassing noise. An optional display panel 98 informs the user of the status of the environmentally controlled toilet, and delivers customized messages.

The invention as depicted in the drawings previously described is directed to elements that are added to a toilet bowl of a new or an existing design. It will be noted however that the same structural elements relative to the air distribution system and sanitizer/conditioner dispensing means may be further incorporated into the toilet bowl structure itself. Therefore, the invention is not limited to a design that incorporates all of the elements as thus described.

While the present invention has been particularly described in several embodiments, it should be understood that the figures are for illustration purposes only and should not be taken as limitation on the invention. In addition, it is clear that the method and apparatus of the present invention have utility in any toilet system where the control of the environment—whether it be bacteria, odor, audio, or temperature—is required.It is contemplated that many changes and modifications may be made by one of ordinary skill in the art without departing from the spirit and scope of the invention as disclosed.

I claim:

1. An environmentally controlled toilet bowl connected to a sewer line and having an upper rim and a circular bowl-skirt integral with said rim and extending downwardly into the said bowl to form a primary air trapping cavity within said bowl, said bowl-skirt having at least one exhaust passage and at least one inlet window therein, b) a bowl flushing means permitting water to enter said bowl and flush matter therefrom, and c) an air circulating means for lowering the temperature of the contaminated air inside said bowl and for providing a flow of air through said at least one exhaust passage, moving air inside said bowl, and returning to said air circulation means through said at least one inlet window, wherein the moving air inside said bowl resembles a cyclone-type air circulation that generates secondary air currents that move radially from said bowl center, carrying airborne contaminants from the bowl center to said primary air trapping cavity, and mixing them with the air sweeping tangentially inside said primary air rapping cavity comprising: a toilet bowl having a bowl top, a bowl rim and inside walls, said bowl being connected to a sewer line; a bowl flushing means permitting water to enter said bowl and flush matter therefrom; an air circulation means for recirculating air inside said bowl; and a sanitizer/-conditioner means for dispensing odor conditioning and sanitizing agents into recirculating air returning to said bowl, wherein said bowl has an upper rim and a circular bowl-skirt integral with said rim extending downwardly into said bowl to form a primary air trapping cavity between said bowl walls and said bowl skirt, said bowl having at least one exhaust passage positioned inside said air trapping cavity allowing a flow of air generated by said air circulation means to enter tangentially inside said air trapping cavity and to generate a circular air movement inside said circular air trapping cavity and further said bowl having at least one inlet window positioned inside said air trapping cavity to return the recirculated air from within said bowl to said air circulation means, wherein the moving air inside said air trapping cavity resembles a cyclone-type air circulation that generates secondary air currents with said bowl that move radially from a center of said bowl, wherein said secondary air currents carry warmer and contaminated air from the bowl center to said air trapping cavity to neutralize and mix said contaminated air with said odor conditioning and sanitizing agents dispensed by said air circulation means in he air moving tangentially inside said air trapping cavity thus reducing bacteria count and conditioning the odor within said bowl, furthermore the cyclone-type air circulation inside said air trapping cavity mixes cooler air sweeping along the toilet bowl walls with said warmer and contaminated air to lower the temperature of said warmer contaminated air and to force condensation of vapors present in said contaminated by bringing the vapors into contact with the cooler toilet bowl walls.

2. The toilet as recited in claim 1 wherein said air circulating means further comprises an electrical motor and a rotor enclosed within a housing creating a pressurized air flow, said housing having interior chambers, channels and openings, to direct the air flow through said at least one exhaust passage into said primary air trapping cavity and returning to said housing via said at least one inlet window.

3. The toilet as recited in claim 2 wherein said housing is attached to said bowl top contiguous with the bowl rim.

4. The toilet as recited in claim 3 further comprising a seat hingeably attached to said housing, said seat having an external perimeter and a toilet seat cover hingeably attached to said toilet seat, said seat cover conforming to the external perimeter and contour of said seat.

5. The toilet as recited in claim 2 wherein said sanitizer/conditioner dispensing means comprises a cartridge that is in a solid form.

6. The toilet as recited in claim 2 wherein said sanitizer/conditioner dispensing means comprises a container filled with sanitizing and odor conditioning agents in a liquid form that is dispersed by means of a pump.

7. The toilet as recited in claim 2 wherein said housing contains said sanitizer/conditioner dispensing means which comprises a container filled with sanitizing and odor conditioning liquid that is dispensed by a wick extending into the air circulated within said housing.

8. The toilet as recited in claim 2 further comprising a power means for furnishing electrical power to said electrical motor.

* * * * *

UNITED STATES PATENT AND TRADEMARK OFFICE

CERTIFICATE OF CORRECTION

PATENT NO. : 5,210,884

DATED : May 18, 1993

INVENTOR(S) : Daniel S. Redford

It is certified that error appears in the above-indentified patent and that said Letters Patent is hereby corrected as shown below:

Column 13, lines 46 to 66, Claim 1: "toilet bowl connected to a sewer line and having an upper rim and a circular bowl-skirt integral with said rim and extending downwardly into the said bowl to form a primary air trapping cavity within said bowl, said bowl-skirt having at least one exhaust passage and at least one inlet window therein, b) a bowl flushing means permitting water to enter said bowl and flush matter therefrom, and c) an air circulating means for lowering the temperature of the contaminated air inside said bowl and for providing a flow of air through said at least one exhaust passage, moving air inside said bowl, and returning to said air circulation means through said at least one inlet window, wherein the moving air inside said bowl resembles a cyclone-type air circulation that generates secondary air currents that move radially from said bowl center, carrying airborne contaminants from the bowl center to said primary air trapping cavity, and mixing them with the air sweeping tangentially inside said primary air rapping cavity comprising:" should read as

UNITED STATES PATENT AND TRADEMARK OFFICE

CERTIFICATE OF CORRECTION

PATENT NO. : 5,210,884
DATED : May 18, 1993
INVENTOR(S) : Daniel S. Redford

It is certified that error appears in the above-indentified patent and that said Letters Patent is hereby corrected as shown below:

--toilet comprising:--

Signed and Sealed this

Twelfth Day of April, 1994

Bruce Lehman

*Attest:*

BRUCE LEHMAN

*Commissioner of Patents and Trademarks*

*Attesting Officer*